US009341313B2

(12) United States Patent
Chang

(10) Patent No.: US 9,341,313 B2
(45) Date of Patent: May 17, 2016

(54) GAS HOOD FOR GAS REGULATOR

(75) Inventor: Shih-Hsun Chang, Taichung (TW)

(73) Assignee: UNITED MICROELECTRONICS CORP., Science-Based Industrial Park, Hsin-Chu (TW)

( * ) Notice: Subject to any disclaimer, the term of this patent is extended or adjusted under 35 U.S.C. 154(b) by 703 days.

(21) Appl. No.: 13/528,864

(22) Filed: Jun. 21, 2012

(65) Prior Publication Data

US 2013/0340858 A1 Dec. 26, 2013

(51) Int. Cl.
*F17C 13/10* (2006.01)

(52) U.S. Cl.
CPC ..... *F17C 13/10* (2013.01); *F17C 2205/0176* (2013.01); *F17C 2205/0338* (2013.01); *F17C 2260/032* (2013.01); *F17C 2270/0518* (2013.01); *Y10T 137/7043* (2015.04)

(58) Field of Classification Search
CPC ..... F16K 27/12; F16P 1/00; F16P 1/02; F17C 13/10
USPC ..... 137/377, 382; 62/459; 261/127–128
See application file for complete search history.

(56) References Cited

U.S. PATENT DOCUMENTS 1,988,289 A * 1/1935 Wittemann ..... 261/128
4,380,245 A * 4/1983 Hefner ..... 137/375
4,389,890 A * 6/1983 Bolick et al. ..... 73/431
4,478,345 A * 10/1984 Edinger ..... 220/724
4,834,137 A * 5/1989 Kawaguchi et al. ..... 137/557
4,903,719 A * 2/1990 Rains ..... F16K 27/006 137/15.17
5,086,804 A * 2/1992 Ngai ..... 137/312
5,158,204 A * 10/1992 Martrich et al. ..... 220/727
5,301,723 A * 4/1994 Goode ..... F17C 5/02 141/11
5,907,107 A 5/1999 Welker
6,003,540 A * 12/1999 Bruni et al. ..... 137/312
2002/0014267 A1* 2/2002 Heald ..... F16K 27/12 137/505
2004/0016240 A1* 1/2004 Brook ..... F17C 5/007 62/52.1
2006/0070662 A1* 4/2006 Gremillion, III ..... F16K 27/12 137/382
2006/0169323 A1* 8/2006 Parker ..... 137/382
2009/0301581 A1* 12/2009 MacNeal ..... F16K 1/306 137/505.14
2014/0158206 A1* 6/2014 Ellis et al. ..... 137/1
2014/0196792 A1* 7/2014 Torres-Leon ..... F16K 27/12 137/1

* cited by examiner

*Primary Examiner* — Craig Schneider
*Assistant Examiner* — Daniel P Donegan
(74) *Attorney, Agent, or Firm* — Winston Hsu; Scott Margo

(57) ABSTRACT

A gas hood for a gas regulator comprises a housing for covering a gas regulator, an opening for receiving the gas regulator and semi-sealing the space between the housing and the gas regulator, and a gas inlet for constantly introducing gas into the space, wherein parts of the gas escapes from the opening so that the space can maintain a micro-positive pressure.

16 Claims, 5 Drawing Sheets

GAS HOOD FOR GAS REGULATOR

BACKGROUND OF THE INVENTION

1. Field of the Invention

The present invention generally relates to a gas hood for a gas regulator. More particularly, the present invention relates to a gas hood that prevents water vapor from condensing on a gas regulator.

2. Description of the Prior Art

Regulator is a critical device in high-pressure gas supply system. When gas is released from a high-pressure gas source (ex. a liquid gas cylinder), the pressure of the gas may be higher than 500 psi (pound per square inch). The gas with such an enormous pressure can't be readily used in most gas processing equipments or process tools. For this reason, the output pipeline of high-pressure gas source should be equipped with gas regulators to lower the pressure of output gas down to a normal level, such as dozens of psi, so that the output gas can be processed or utilized.

Please refer to FIG. 1, which is a cross-sectional view of a gas regulator 100 conventionally used in prior art. As shown in FIG. 1, the gas from a high-pressure gas source (not shown) will be introduced into the gas regulator 100 via an input pipeline 103 and then be extracted after the pressure is reduced via an output pipeline 105. During the gas supplying and pressure reducing steps, the pressure of the gas passing through the gas regulator 100 is dramatically reduced. In the meantime, the temperature of the gas regulator 100 is severely reduced to a level lower than the dew point temperature, due to the Joule-Thomson effect. Therefore, the water vapor 107 will condense on the sidewall 109 and the base 111 of the gas regulator 100. The condensation of water vapor on the gas regulator will inhibit the heat exchanges between the cooled gas regulator 100 and the ambient air. Eventually, the gas regulator will freeze. If the condensing issues and freezing issues of the gas regulator can't be improved, the gas passing through the regulator will be cooled, thereby increasing the density of the gas. This may have severe impact in precise semiconductor processes.

Accordingly, it is still necessary to develop a novel approach to resolve the above-mentioned water vapor condensation issue on gas regulators.

SUMMARY OF THE INVENTION

In the light of the above-mentioned technologies of prior art that can't effectively solve the water condensation issue in gas regulators, a novel gas hood for gas regulators is provided in the present invention. The principle of the present invention is to constantly introduce a purge gas to insulate the water vapor from getting close or contacting the gas regulator, so that no water vapor can condense on the gas regulator, even when the temperature of gas regulator has decreased.

According to one aspect of the present invention, the gas hood comprises an annular body surrounding the gas regulator. The opening of the gas hood is slightly spaced apart from the gas regulator so that the space defined between the gas hood and the gas regulator may be insulated from the external environment as much as possible. A gas inlet can constantly introduce purge gas into the space to purge out the gas in the space.

According to another aspect of the present invention, the gas hood comprises a housing for covering on a gas regulator, an opening for receiving the gas regulator and semi-sealing the space between the housing and the gas regulator, and a gas inlet for constantly introducing gas into the space, wherein some of the gas may escape from the opening, so that the space can be maintained in a micro-positive pressure.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The accompanying drawings are included to provide a further understanding of the embodiments, and are incorporated in and constitute apart of this specification. The drawings illustrate some of the embodiments and, together with the description, serve to explain their principles. In the drawings.

Figure 1:
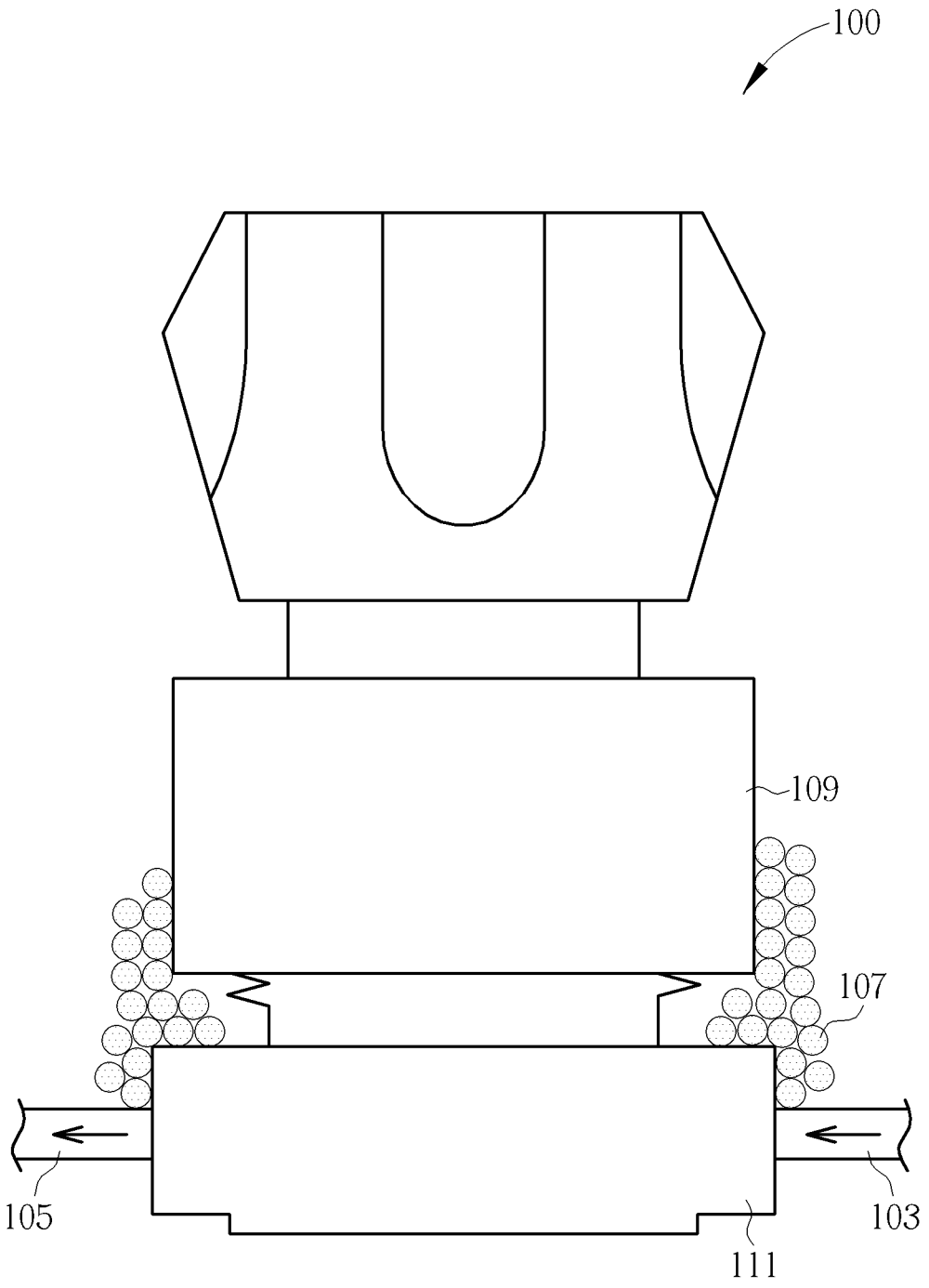
FIG. 1 is a cross-sectional view illustrating the water vapor condensing on a gas regulator due to the J-T effect in prior art.

It should be noted that all the figures are diagrammatic. Relative dimensions and proportions of parts of the drawings have been shown exaggerated or reduced in size, for the sake of clarity and convenience in the drawings. The same reference signs are generally used to refer to corresponding or similar features in modified and different embodiments.

DETAILED DESCRIPTION

In the following detailed description of the invention, reference is made to the accompanying drawings which form a part hereof, and in which is shown, by way of illustration, specific embodiments in which the invention may be practiced. These embodiments are described in sufficient details to enable those skilled in the art to practice the invention. Other embodiments may be utilized and structural, logical, and electrical changes may be made without departing from the scope of the present invention.

Figure 2:
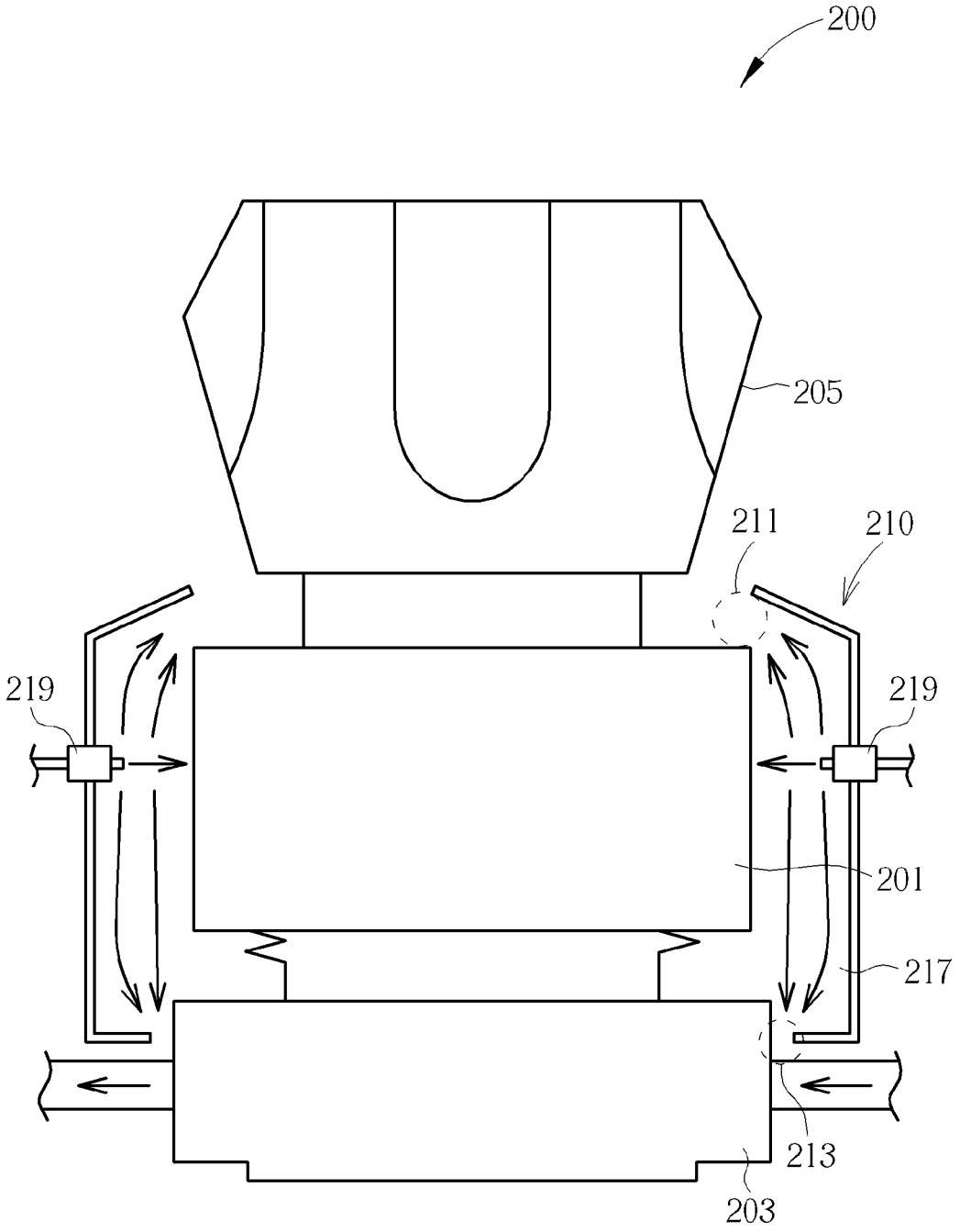
FIG. 2 is a cross-sectional view illustrating a gas hood mounted on a gas regulator in accordance with one embodiment of the present invention.

First, please refer to FIG. 2, which is a cross-sectional view illustrating a gas hood 210 mounted on a gas regulator 200 in accordance with one embodiment of the present invention. To overcome the issue of water vapor condensing on the gas regulator in prior art, the principle of the present invention is to insulate the water vapor from getting close to or contacting the gas regulator. As shown in FIG. 2, the present invention provides a gas hood 210 for a gas regulator. The gas hood 210 is an annular housing surrounding a gas regulator 200. The gas hood 210 encompasses the region of the sidewall 201, the base 203, and portions of the gas regulator 200 where the cooling effect is most prominent, that is, the region where water vapor is most likely to condense. The gas hood 210 may be fitted on the sidewall 201 and the base 203 of the gas regulator 200 from the end of handle 205. When the installation is completed, the upper annular opening 211 and lower annular opening 213 is slightly spaced apart from the gas regulator 200, so that the space 217 defined between the gas hood 210 and the gas regulator 200 may be insulated from the ambient air as much as possible.

To prevent the ambient water vapor from diffusing into the space 217, the approach in the first embodiment of the present invention is to constantly introduce purge gas into the space 217 to purge out the gas in the space 217. This way, ambient gas will not be allowed into the space 217. The purge gas may be introduced from the gas inlet 219 on the gas hood 210 and then be purged out from the upper annular opening 211 and the lower annular opening 213, as shown with the arrow in the FIG. 2. Through this approach, since the water vapor is insulated, no condensation of water vapor is observed on the gas regulator, even when the temperature of the gas regulator is reduced to a level lower than the dew point temperature by the J-T effect. The removal of the condensing water vapor may facilitate the heat exchanges between the gas regulator and the ambient environment, thereby improving the stability of the gas supply system and the introduced process gas. In the present invention, the introduced purge gas should be a low moisture content gas, wherein nitrogen or cool dry air (CDA) is preferred. Moreover, the introduced purge gas may be pre-heated before entering the regulator, so that the purge gas can also provide heat energy to the gas regulator during the purge process.

Figure 3:
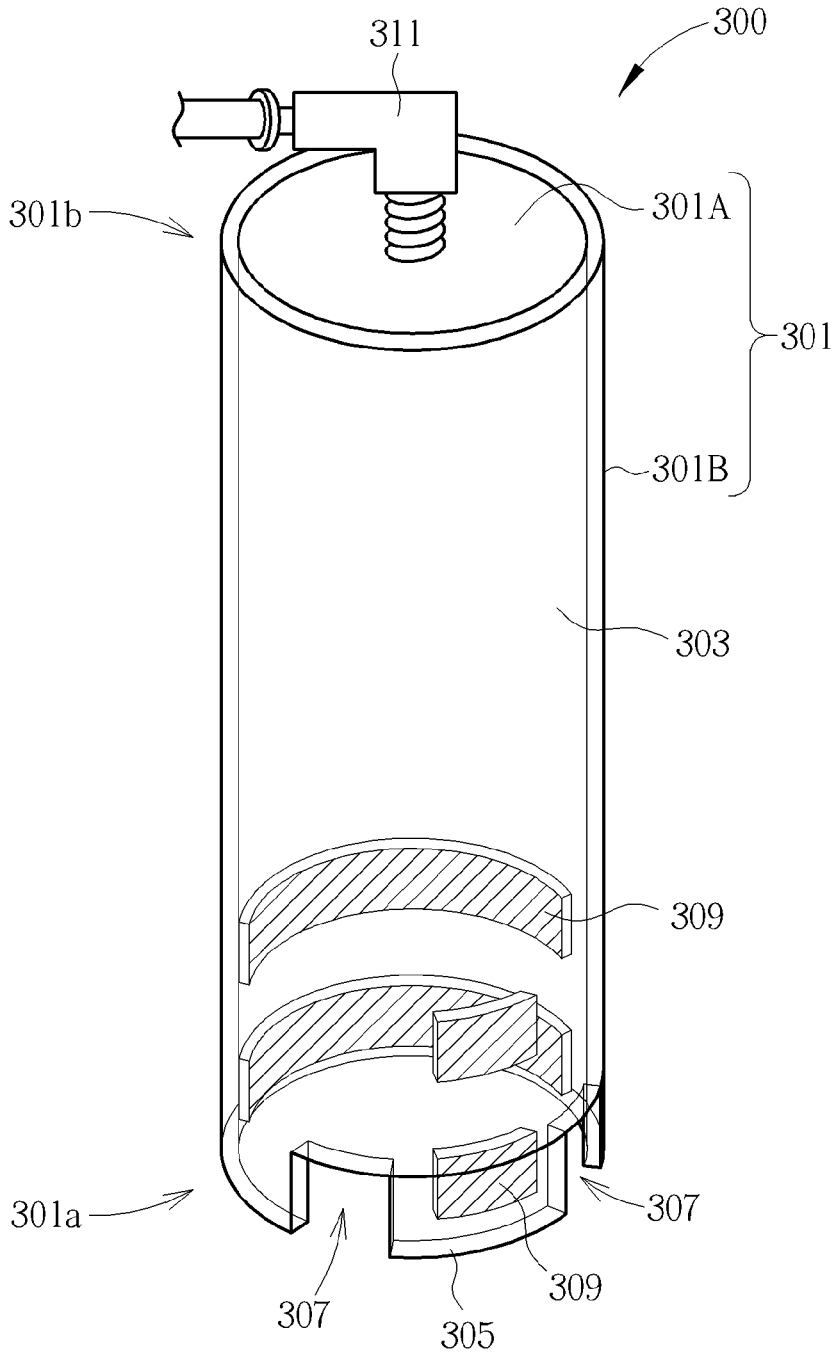
FIG. 3 is an isometric view of a gas hood for a gas regulator in accordance with another embodiment of the present invention.

In addition to the aforementioned embodiment, the present invention also provides other better, more efficient embodiments. Please refer to FIG. 3, which is an isometric view illustrating the gas hood 300 for a gas regulator in accordance with another embodiment of the present invention. As shown in FIG. 3, the main body of the gas hood 300 is a cylindrical housing 301, such as an acrylic tube with a hollow inner accommodating space 303. The housing 301 has a top wall 301A and a sidewall 301B positioned below the to wall 301A and connecting with the to wall 301A. The top wall 301A and the sidewall 301B are non-parallel to each other and are not coplanar. One end 301*a* (ex. bottom end) of the housing 301 is provided with an opening 305 communicating with the inner accommodating space 303, which means the opening 305 is disposed at the bottom side of the sidewall 301B. The gas regulator may be placed into the accommodating space 303 via this opening 305. The opening 305 includes several recesses 307 to allow the passing of the gas input/output pipelines which are connected to the gas regulator. In the present invention, the inner sidewall of the housing 301 near the opening 305 is equipped with a plurality of fixed pieces 309. These fixed pieces 309 are used to mount the housing 301 on the gas regulator. The other end 301*b* of the housing 301 opposite to the opening 305 and the bottom end 301*a*, such as the top end, is provided with a gas inlet 311 communicating with the inner accommodating space 303. Therefore, the gas inlet 311 is disposed at the top wall 301A. The gas inlet 311 may be connected to an external gas source or a conduit to introduce the purge gas.

Please note that the housing 301 illustrated in FIG. 3 is a cylindrical body. In the actual implementation, the housing 301 may be a cube body depending on the shape of the gas regulator and the space allowed for the installation, as long as the housing 301 is compactly covered on the regulator. Besides, the position of the gas inlet 311 is not necessary on the top side of the housing 301. It may be disposed on the sidewall of the housing 301, and the housing may include multiple gas inlets, as long as the gas in space 303 can be purged uniformly and steadily out of the housing 301 after the installation.

Figure 4:
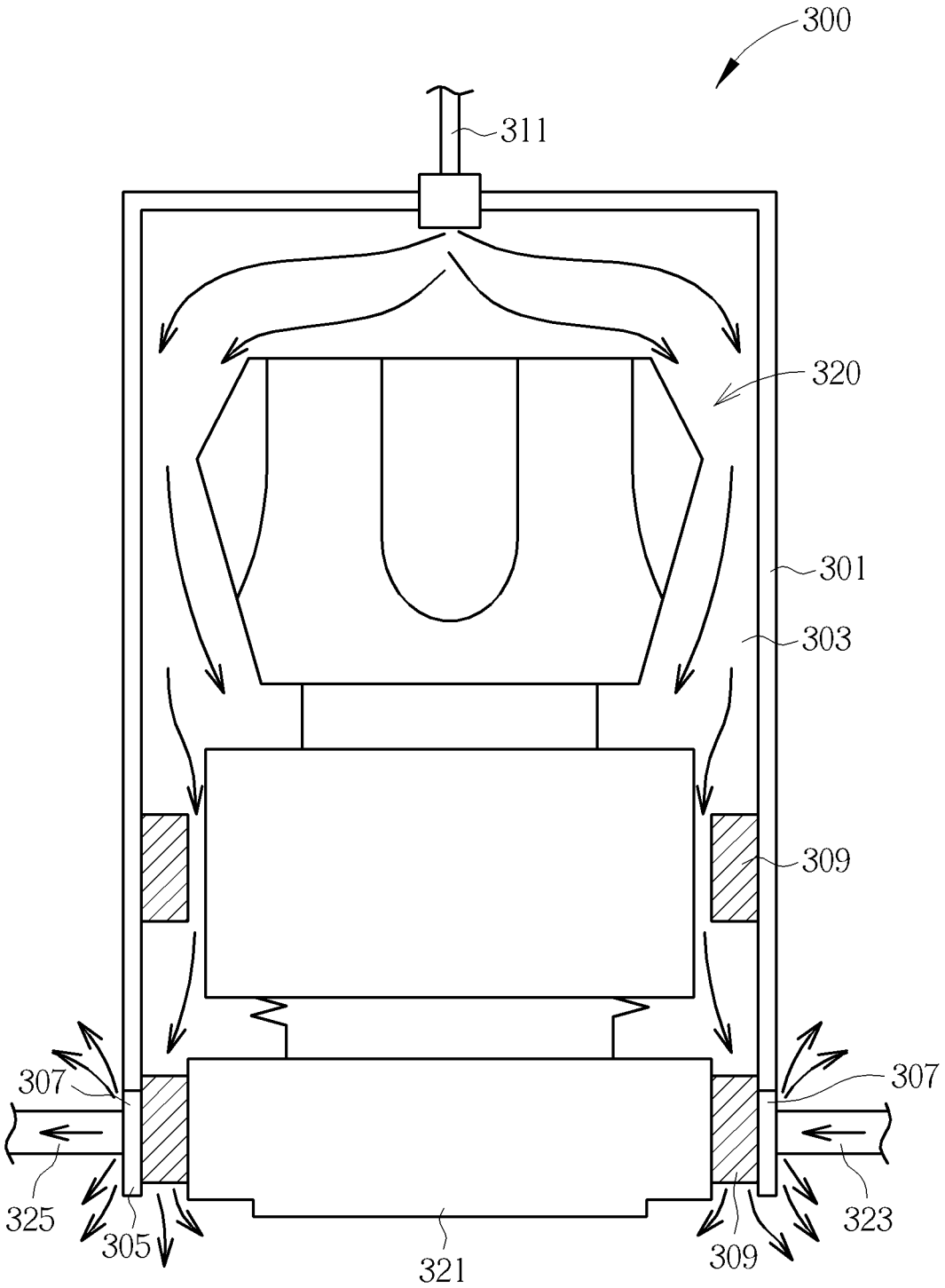
FIG. 4 is a cross-sectional view illustrating the gas hood of FIG. 3 mounted on a gas regulator.

Please refer to FIG. 4, which is a cross-sectional view illustrating the gas hood 300 of FIG. 3 mounted on a gas regulator 320. As shown in FIG. 4, the fixed pieces 309 disposed near the opening 305 of the housing 301 contact and surround the base 321 of the gas regulator 320 when the gas hood 300 is mounted on the gas regulator 320. The fixed pieces may be made of elastic material, such as rubber or foam, wherein the elasticity of the fixed pieces may mount the housing 301 on the gas regulator 320 and semi-seal the space 303 between the housing 301 and the gas regulator 320. The gas hood 300 of the present invention is an easily-installed device, and it can be installed without stopping the supply of process gas. The input/output pipelines 323 and 325 of the gas regulator 320 may extend out of the housing 301 via the recesses 307 of the housing 301. The input pipeline 323 is connected to a high-pressure gas source to introduce the process gas into the gas regulator 320. The process gas is output from the output pipeline 325 at the other side after pressure reducing. In the present invention, the prominence of J-T effect on the gas regulator depends on several factors, such as the pressure, the species, and the flow of the introduced high-pressure gas. Generally, alkanes, $CO_2$, or $CF_4$ will induce significant temperature reduction on the gas regulator.

One of the differences between the present embodiment and the embodiment shown in FIG. 2 are fixed pieces. The gas hood in the present embodiment is provided with additional fixed pieces to mount the housing 301 on the gas regulator 320 and construct a semi-sealed inner space. In the present embodiment, as shown in FIG. 4, purge gas (ex. $N_2$ or CDA) may be introduced into the housing 301 via the gas inlet 311 of the gas hood 300. Since the space 303 between the housing 301 and the gas regulator 320 is kept in a semi-sealed state, parts of the purge gas will escape from the gaps between the recesses 307 and input/output pipelines 323 and 325, as shown by the arrows in FIG. 4. With this kind of design, the necessary flow of the purge gas to maintain the micro-positive pressure state in this embodiment is tiny. For example, the space 303 may maintain a micro-positive pressure state to prevent the water vapor from diffusing into the housing 301 by controlling the flow of the purge gas under merely 2 slpm (standard liter per minute). In comparison to the present embodiment, the first embodiment shown in FIG. 2 may need a great amount of purge gas (ex. higher than 40 slpm) to keep the micro-positive pressure state. According to this comparison, the approach of the present embodiment is more energy-efficient and cost-saving.

On the other hand, the housing 301 of the present embodiment is a cylindrical body, wherein only a bottom opening is provided to receive the gas regulator 320 and purge out the gas. This feature is slightly different from the annular housing with the upper and lower openings in the first embodiment. In the present embodiment, as shown in FIG. 4, the purge gas is introduced into the housing 301 from the top gas inlet 311. The purge flow will pass smoothly through the space 303 and then escape from the gaps between the bottom recesses 307 of the housing 301 and the output/input pipelines 323 and 325. The design of the hood structure in the present embodiment may facilitate and improve the purging and the cleansing of the inner space 303. In comparison, the hood structure of the first embodiment may form disturbed flows in the inner space due to the design of the lateral input of the purge gas and the dual upper and lower openings, thereby failing to completely and uniformly purge the water vapor out of the gas hood.

Figure 5:
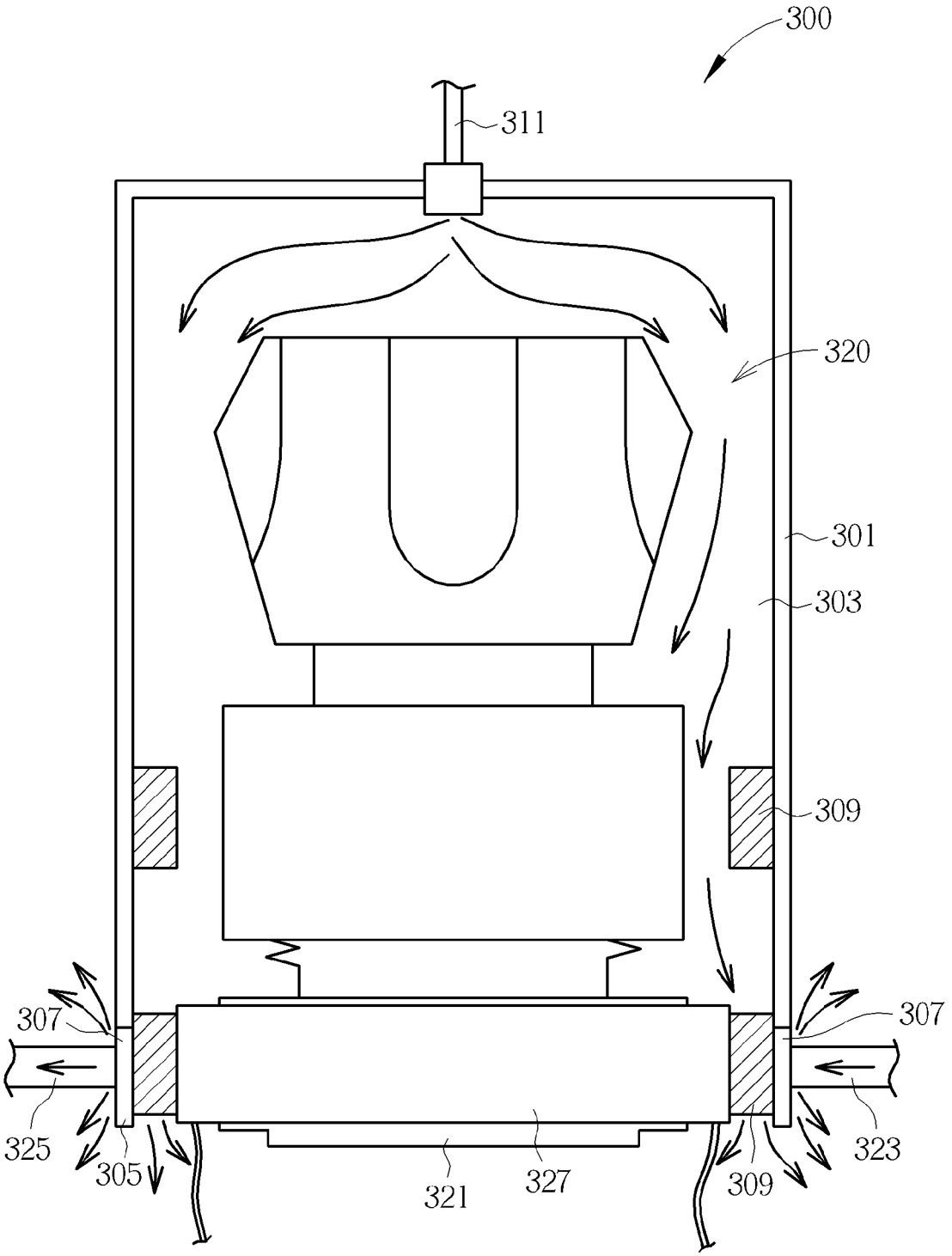
FIG. 5 is a cross-sectional view illustrating a gas hood mounted on a gas regulator with a heating jacket in accordance with one embodiment of the present invention.

Subsequently, please refer to FIG. 5, which is a cross-sectional view illustrating a gas hood mounted on a gas regulator with a heating jacket in accordance with one embodiment of the present invention. The gas hood in the present invention may cooperate with a heating jacket. A heater may be equipped at the upstream pipeline of the gas regulator to pre-heat the introduced high-pressure gas. Alternatively, the gas regulator maybe installed with a heating jacket to heat the introduced high-pressure gas. Both of the two approaches can evaporate the condensing water and increase the temperature of the gas regulator by providing heat energy. However, in actual practice, since the vaporization heat of water is very large, the heat provided by the heating jacket can only remove parts of the water condensing on the regulator. The water condensing issue is not completely resolved. Moreover, the use of a heating jacket is quite cost-wasting, and the local concentration of heat energy is apt to deteriorate the introduced process gas. This is not an ideal solution. Trough cooperating with the gas hood of the present invention, as shown in FIG. 5, the base 321 of gas regulator 320 is surrounded by a heating jacket 327. The heating jacket 327 can increase the temperature around the base 321 to a level higher than the dew point temperature, and the gas hood 300 covering the gas regulator may inhibit the water vapor from entering into the inner space of the gas hood. The cooperation of the two devices can completely solve the issue of water condensation and achieve a stable gas supply. On the other hand, the gas hood 300 of the present invention may be optionally installed with other functional devices, such as a barometer, a hygrometer, or a thermometer, to monitor various gas parameters (ex. pressure, moisture, or temperature) inside the space 303. Theses parameters may be used to determine if the purge gas should be introduced or if the heating jacket should be activated.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A gas hood for a gas regulator, wherein said gas regulator is connected to a gas input pipeline and a gas output pipeline, the gas hood comprising:

a housing for covering a gas regulator, wherein the housing has a bottom end;

an opening disposed at said bottom end of said housing for receiving said gas regulator and semi-sealing a space between said housing and said gas regulator, wherein said bottom end of said housing forms said opening and said opening further comprises a plurality of recesses disposed at said bottom end of said housing to allow passing of said gas input pipeline and said gas output pipeline; and a gas inlet for constantly introducing gas into said space so that parts of said gas escapes from said opening and said space can maintain a micro-positive pressure, wherein said gas inlet is disposed at a top end of said housing and said top end is opposite to said bottom end of said housing and is sealed off, wherein said gas input pipeline and said gas output pipeline are respectively extended through said recesses of said openings into said space between said housing and said gas regulator at said bottom end of said housing, with gaps formed between said recesses and said gas input/output pipelines.

2. The gas hood for a gas regulator according to claim 1, wherein said introduced gas is nitrogen or clean dry air (CDA).

3. The gas hood for a gas regulator according to claim 1, wherein the flow of said introduced gas is lower than 2 slpm.

4. The gas hood for a gas regulator according to claim 1, further comprising a plurality of fixed pieces disposed around the inner sidewall of said housing near said opening for mounting said gas hood on said gas regulator and achieving a semi-sealing state in said space, wherein said bottom end of said housing is semi-sealed by said opening and said fixed pieces.

5. The gas hood for a gas regulator according to claim 1, wherein said opening and said gas inlet are disposed at opposite sides of said housing.

6. The gas hood for a gas regulator according to claim 5, wherein the housing has a top wall and a sidewall positioned below said top wall and connecting with said top wall, said gas inlet is disposed at said top wall of said housing, and said opening is disposed at the bottom side of said sidewall.

7. The gas hood for a gas regulator according to claim 1, wherein said housing covers the entire gas regulator.

8. The gas hood for a gas regulator according to claim 1, wherein said gas hood is further installed with a barometer or a hygrometer for monitoring the gas parameters inside said space.

9. The gas hood for a gas regulator according to claim 1, wherein said gas regulator is connected to a high-pressure gas source, and the gas from said high-pressure gas source causes the temperature reduction of said gas regulator.

10. The gas hood for a gas regulator according to claim 9, wherein said high-pressure gas source is a liquid gas cylinder.

11. The gas hood for a gas regulator according to claim 9, wherein the gas from said high-pressure gas source comprises alkanes, $CO_2$, or $CF_4$.

12. The gas hood for a gas regulator according to claim 9, further comprising a heating jacket installed on said gas regulator.

13. The gas hood for a gas regulator according to claim 6, wherein the top wall and the sidewall are non-parallel to each other and are not coplanar.

14. The gas hood for a gas regulator according to claim 1, wherein a base of said gas regulator is not covered by said opening from said bottom end of said housing when said housing is mounted on said gas regulator.

15. The gas hood for a gas regulator according to claim 14, wherein said base of said gas regulator is surrounded by said bottom end of said housing, and said gas input/output pipelines are connected to said base of said gas regulator.

16. The gas hood for a gas regulator according to claim 6, wherein said recesses are connected to an edge of said opening and exposed by said opening from said bottom end of said housing, not enclosed by said sidewall of the housing.

* * * * *